US010606190B2

(12) United States Patent
Yoshida et al.

(10) Patent No.: US 10,606,190 B2
(45) Date of Patent: Mar. 31, 2020

(54) IMAGE FORMING APPARATUS THAT COLLECTS TONER REMAINING ON INTERMEDIATE TRANSFER MEMBER USING MEMBER IN ABUTMENT WITH INTERMEDIATE TRANSFER MEMBER

(71) Applicant: CANON KABUSHIKI KAISHA, Tokyo (JP)

(72) Inventors: Tsuguhiro Yoshida, Yokohama (JP); Shinji Katagiri, Yokohama (JP); Takayuki Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/383,451

(22) Filed: Apr. 12, 2019

(65) Prior Publication Data

US 2019/0332041 A1 Oct. 31, 2019

(30) Foreign Application Priority Data

Apr. 27, 2018 (JP) ..... 2018-087530
Feb. 6, 2019 (JP) ..... 2019-019540

(51) Int. Cl.
*G03G 15/16* (2006.01)

(52) U.S. Cl.
CPC ..... *G03G 15/162* (2013.01); *G03G 15/161* (2013.01); *G03G 2215/1623* (2013.01); *G03G 2215/1661* (2013.01)

(58) Field of Classification Search
CPC ..... G03G 15/162; G03G 15/161; G03G 2215/1623; G03G 2215/1661; G03G 13/16; B41M 5/0256
USPC ..... 399/101, 302, 308; 430/125.4
See application file for complete search history.

(56) References Cited

U.S. PATENT DOCUMENTS 8,913,916 B2 * 12/2014 Kawamata ..... G03G 21/0064 399/101
8,971,765 B2 * 3/2015 Inagaki ..... G03G 15/162 399/162
9,195,176 B2 * 11/2015 Seki ..... G03G 15/161

FOREIGN PATENT DOCUMENTS

| | | | |
|---|---|---|---|
| JP | 2005-128510 A | | 5/2005 |
| JP | 2012042655 A | * | 3/2012 |
| JP | 2013-068733 A | | 4/2013 |
| JP | 2015106138 A | * | 6/2015 |
| JP | 2015125187 A | | 7/2015 |
| JP | 2016186582 A | * | 10/2016 |
| JP | 2018-025832 A | | 2/2018 |

* cited by examiner

*Primary Examiner* — Robert B Beatty
(74) *Attorney, Agent, or Firm* — Canon U.S.A., Inc. IP Division

(57) ABSTRACT

An intermediate transfer belt includes a surface layer with a solid lubricant added therein on an outer peripheral surface side in abutment with a photosensitive drum and a cleaning blade in a thickness direction. Further, the surface layer includes a plurality of grooves formed along a movement direction of the intermediate transfer belt in a width direction of the intermediate transfer belt. The intermediate transfer belt including the grooves satisfies $J\times(1/K)\times L\times(Q/\rho_P)/((Q/\rho_P)+(100/\rho_A))<240$.

23 Claims, 9 Drawing Sheets

IMAGE FORMING APPARATUS THAT COLLECTS TONER REMAINING ON INTERMEDIATE TRANSFER MEMBER USING MEMBER IN ABUTMENT WITH INTERMEDIATE TRANSFER MEMBER

BACKGROUND OF THE DISCLOSURE

Field of the Disclosure

The present disclosure relates to an electrophotographic image forming apparatus, such as a copying machine and a printer.

Description of the Related Art

Conventionally, there has been known a configuration using the intermediate transfer method among electrophotographic color image forming apparatuses. According to the intermediate transfer method, toner images are sequentially transferred from image forming units for respective colors onto an intermediate transfer member, and further collectively transferred from the intermediate transfer member onto a transfer material.

In such an image forming apparatus, each of the image forming units for the respective colors includes a drum-like photosensitive member (hereinafter referred to as a photosensitive drum) as an image bearing member. Further, an intermediate transfer belt made of an endless belt is widely used as the intermediate transfer member. The toner image formed on the photosensitive drum of each of the image forming units is primarily transferred onto the intermediate transfer belt by application of a voltage from a primary transfer power source to a primary transfer member provided so as to face the photosensitive drum via the intermediate transfer belt. The toner images of the respective colors primarily transferred from the image forming units for the respective colors onto the intermediate transfer belt are collectively secondarily transferred from the intermediate transfer belt onto a transfer material such as paper and an overhead projector (OHP) sheet by application of a voltage from a secondary transfer power source to a secondary transfer member at a secondary transfer portion. The toner images of the respective colors transferred on the transfer material are subsequently fixed onto the transfer material by a fixing unit.

In the image forming apparatus using the intermediate transfer method, the toner remains on the intermediate transfer belt (transfer residual toner) after the toner images are secondarily transferred from the intermediate transfer belt onto the transfer material. Therefore, this image forming apparatus raises a necessity of removing the transfer residual toner remaining on the intermediate transfer belt before toner images corresponding to a next image are primarily transferred onto the intermediate transfer belt.

The blade cleaning method is widely used as a cleaning method for removing the transfer residual toner. According to the blade cleaning method, the transfer residual toner is collected into a cleaning container by being raked up by a cleaning blade disposed on a downstream side of the secondary transfer portion in a movement direction of the intermediate transfer belt and provided as an abutment member in abutment with the intermediate transfer belt. Generally, an elastic member such as urethane rubber is used as the cleaning blade. This cleaning blade is often disposed with an edge portion of the cleaning blade in pressure contact with the intermediate transfer belt from a direction located so as to oppose the movement direction of the intermediate transfer belt (a counter direction).

Japanese Patent Application Laid-Open No. 2015-125187 discloses a configuration in which grooves along the movement direction of the intermediate transfer belt are formed on a surface of the intermediate transfer belt with a solid lubricant such as fluorine-containing particles added therein with the aim of reducing wear of the cleaning blade.

However, in the configuration that collects the transfer residual toner by bringing the cleaning blade as the abutment member into abutment with the intermediate transfer belt discussed in Japanese Patent Application Laid-Open No. 2015-125187, the solid lubricant may be released from the surface of the intermediate transfer belt by being slidably rubbed with the cleaning blade. The solid lubricant released from the intermediate transfer belt reaches a region where the cleaning blade and the intermediate transfer belt are in contact with each other according to the movement of the intermediate transfer belt. At this time, if the solid lubricant is being deposited excessively by being attached to a distal end of the cleaning blade in abutment with the intermediate transfer belt, a cleaning failure may occur due to an unintended escape of the transfer residual toner via between the cleaning blade and the intermediate transfer belt.

SUMMARY OF THE DISCLOSURE

The present disclosure is directed to allowing the image forming apparatus configured to collect the toner remaining on the intermediate transfer member with use of the abutment member in abutment with the intermediate transfer member to prevent or reduce the excessive deposition of the solid lubricant released from the intermediate transfer member on the region where the abutment member and the intermediate transfer member are in contact with each other.

According to an aspect of the present disclosure, an image forming apparatus includes an image bearing member configured to bear a toner image thereon, a movable intermediate transfer member configured to abut against the image bearing member and receive a primary transfer of the toner image borne by the image bearing member, and a collection unit provided on a downstream side of a secondary transfer portion in a movement direction of the intermediate transfer member. The secondary transfer portion is a portion where the toner image primarily transferred on the intermediate transfer member is secondarily transferred from the intermediate transfer member onto a transfer material. The collection unit includes an abutment member in abutment with the intermediate transfer member, and is configured to collect toner remaining on the intermediate transfer member by the abutment member after the intermediate transfer member passes through the secondary transfer portion. The intermediate transfer member includes a surface layer with a solid lubricant added therein on an outer peripheral surface side in abutment with the image bearing member and the abutment member. The surface layer includes a plurality of grooves formed along the movement direction in a width direction of the intermediate transfer member that intersects with the movement direction. The following formula is satisfied:

$$J\times(1/K)\times L\times(Q/\rho_P)/((Q/\rho_P)+(100/\rho_A))<240,$$

where J, K, L, Q, $\rho_P$, and $\rho_A$ represent a cross-sectional length per groove with respect to the grooves, a pitch of each of the grooves, a circumferential length of the intermediate transfer member that corresponds to a region where the grooves are formed, a contained amount of the solid lubricant, a density of the solid lubricant, and a density of the surface layer, respectively.

Further features and aspects of the present disclosure will become apparent from the following description of example embodiments with reference to the attached drawings.

DESCRIPTION OF THE EMBODIMENTS

In the following description, representative example embodiments of the present disclosure will be described in detail by way of example with reference to the drawings. However, dimensions, materials, shapes, a relative layout, and the like of components that will be described in the following example embodiments shall be changed as appropriate according to a configuration of an apparatus to which the present disclosure is applied and according to various kinds of conditions. Therefore, they are not intended to limit the scope of the present disclosure, unless otherwise specifically indicated.

[Example Configuration of Image Forming Apparatus]

Figure 1:
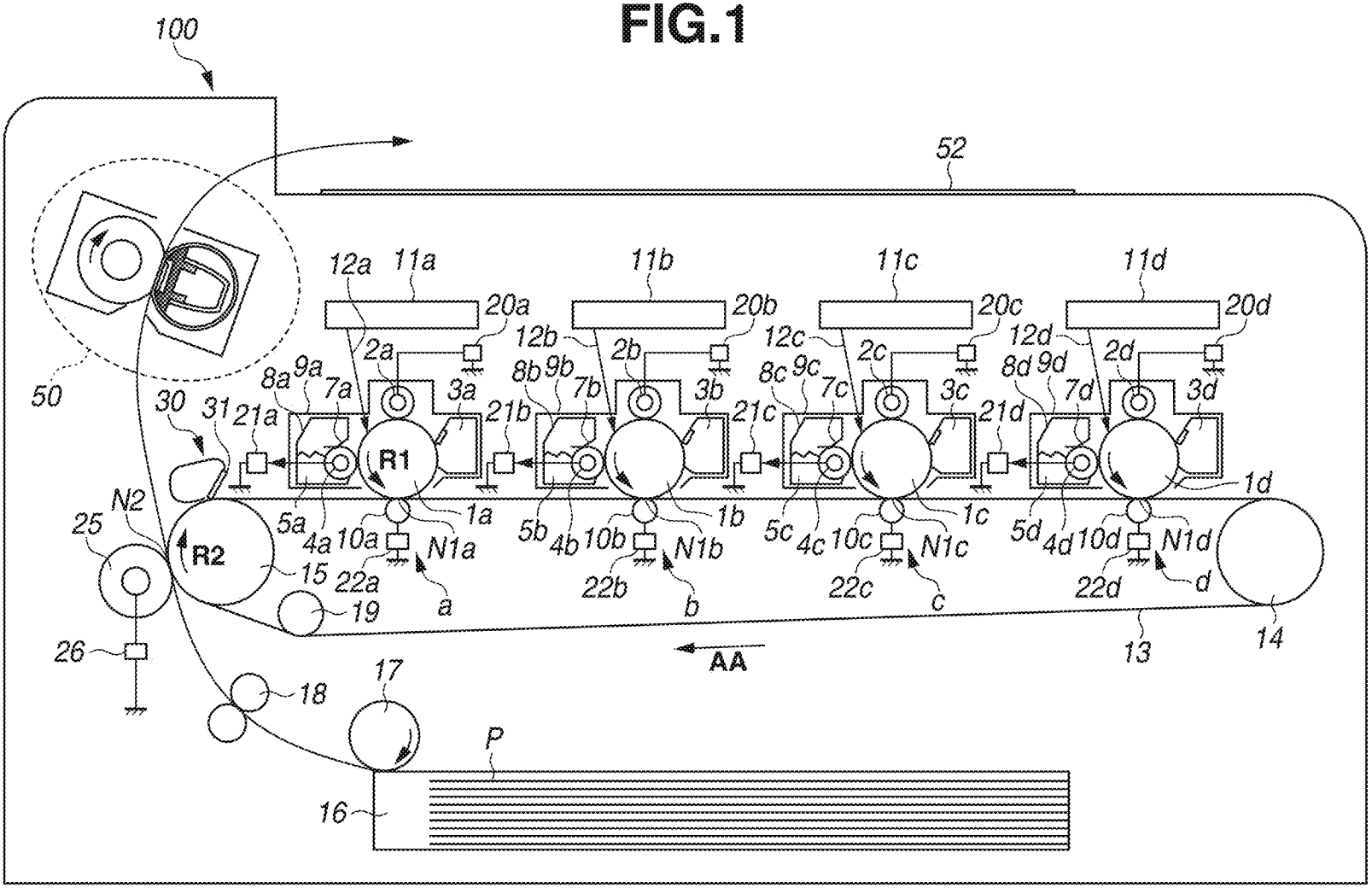
FIG. 1 is a schematic cross-sectional view illustrating an example configuration of an image forming apparatus according to a first example embodiment.

FIG. 1 is a schematic cross-sectional view illustrating a configuration of an image forming apparatus 100 according to a first example embodiment. The image forming apparatus 100 according to the first example embodiment is a tandem-type image forming apparatus including a plurality of image forming units a to d. The first image forming unit a, the second image forming unit b, the third image forming unit c, and the fourth image forming unit d form images with use of respective colors of toner of yellow (Y), magenta (M), cyan (C), and black (Bk), respectively. These four image forming units a to d are arranged in a row at predetermined intervals, and respective configurations of the image forming units a to d are substantially common in many parts except for the color of the toner contained therein. Thus, in the following description, the image forming apparatus 100 according to the present example embodiment will be described with use of the first image forming unit a.

A photosensitive drum 1*a* as an image bearing member is formed by layering, on a metallic cylinder, a plurality of functional organic material layers including a carrier generation layer, which reacts to light to generate a charge, a charge transport layer, which transports the generated charge, and the like. An outermost layer thereof is less electrically conductive and is almost insulative. The photosensitive drum 1*a* rotates at a predetermined circumferential speed in a direction indicated by an arrow R1 illustrated in FIG. 1 by receiving a driving force from a not-illustrated driving source.

A charging roller 2*a* as a charging member is in abutment with the photosensitive drum 1*a*, and evenly charges a surface of the photosensitive drum 1*a* while being driven to rotate according to the rotation of the photosensitive drum 1*a* that is indicated by the direction represented by the arrow R1 illustrated in FIG. 1. The charging roller 2*a* charges the photosensitive drum 1*a* with the aid of a discharge occurring in a micro air gap on each of an upstream side and a downstream side of a charging portion where the charging roller 2*a* and the photosensitive drum 1*a* are in abutment with each other by application of a direct-current voltage from a charging power source 20*a* to the charging roller 2*a*.

A development unit 8*a* includes a development roller 4*a* as a development member and a developer application blade 7*a*, and contains the yellow toner. The development roller 4*a* is connected to a development power source 21*a*. Further, a cleaning unit 3*a* includes a cleaning blade, which contacts the photosensitive drum 1*a*, and a waste toner box, which contains, for example, toner removed from the photosensitive drum 1*a* by the cleaning blade, and collects toner remaining on the photosensitive drum 1*a*. An exposure unit 11*a* includes a scanner unit, which causes laser light to scan with use of a polygonal mirror, and irradiates the photosensitive drum 1*a* with a scanning beam 12*a* modulated based on an image signal. The photosensitive drum 1*a*, the charging roller 2*a*, the cleaning unit 3*a*, and the development unit 8*a* are configured as an integrated process cartridge 9*a* attachable to and detachable from the image forming apparatus 100.

An intermediate transfer belt 13 is stretched by three rollers, namely, a secondary transfer counter roller 15 (hereinafter referred to as a counter roller 15), a tension roller 14, and an assist roller 19 as stretching members. The tension roller 14 is biased by a not-illustrated spring so as to keep an appropriate tensional force applied to the intermediate transfer belt 13. The counter roller 15 rotates in a direction indicated by an arrow R2 illustrated in FIG. 1 by receiving a driving force from a not-illustrated driving source, and the intermediate transfer belt 13 moves in a direction indicated by an arrow AA illustrated in FIG. 1 in accordance with the rotation of the counter roller 15. The intermediate transfer belt 13 is movable at a substantially equal speed in a forward direction with respect to the photosensitive drums 1*a* to 1*d*.

The assist roller 19, the tension roller 14, and the counter roller 15 are electrically grounded. Further, the counter roller 15 is a roller having an outer diameter of 24.0 mm that is formed by coating an aluminum core metal with ethylene propylene diene M-class (EPDM) rubber having a thickness of 0.5 mm, and carbon is dispersed in the EPDM rubber as a conductive agent in such a manner that an electric resistance value is approximately $1\times10^5\Omega$.

A primary transfer roller 10*a* is provided at a position facing the photosensitive drum 1*a* via the intermediate transfer belt 13, and is in contact with an inner peripheral surface of the intermediate transfer belt 13 and is driven to rotate in accordance with the movement of the intermediate transfer belt 13. Further, the primary transfer roller 10*a* is connected to a primary transfer power source 22*a*. In the present example embodiment, the primary transfer rollers 10*a* to 10*d* are each formed by coating a core metal made of a nickel-plated steel rod having an outer diameter of 5 mm with an elastic layer made of a foamable elastic material in such a manner that an outer diameter is 14 mm, and are each adjusted so as to have an electric resistance value of approximately $1\times10^6$. Desirably, the electric resistance of the primary transfer roller 10 falls within a range of $10^3$ to $10^7\Omega$ from the viewpoint of achieving excellent image formation.

A secondary transfer roller 25 is provided at a position facing the counter roller 15 via the intermediate transfer belt 13, and is in contact with an outer peripheral surface of the intermediate transfer belt 13. Further, the secondary transfer roller 25 is connected to a secondary transfer power source 26. In the present example embodiment, the secondary transfer roller 25 is formed by coating around a core metal made of a nickel-plated steel rod having an outer diameter of 6 mm with an elastic layer made of a foamable elastic material in such a manner that an outer diameter is 18 mm, and is adjusted so as to have an electric resistance value of approximately $1\times10^8\Omega$. Desirably, the electric resistance of the secondary transfer roller 25 falls within a range of $10^7$ to $10^9\Omega$ from the viewpoint of achieving excellent image formation.

[Example Image Forming Operation]

Next, an image forming operation of the image forming apparatus 100 according to the present example embodiment will be described. The image forming operation is started by reception of the image signal by a control unit (not illustrated) such as a controller, and the photosensitive drums 1*a* to 1*d*, the counter roller 15, and the like each start rotating at a predetermined circumferential speed (a process speed) by the driving force from the not-illustrated driving source. In the present example embodiment, the process speed is 200 mm/s.

The photosensitive drum 1*a* is evenly charged by the charging roller 2*a* subjected to application of a voltage having the same polarity as a normal charging polarity of the toner (a negative polarity in the present example embodiment) from the charging power source 20*a*. After that, the photosensitive drum 1*a* is irradiated with the scanning beam 12*a* from the exposure unit 11*a*, by which an electrostatic latent image according to image information is formed. The toner contained in the development unit 8*a* is charged so as to become negative in polarity by the developer application blade 7*a*, and is applied to the development roller 4*a*. Then, a predetermined voltage is applied from the development power source 21*a* to the development roller 4*a*, by which the electrostatic latent image is developed with the toner at a development portion where the development roller 4*a* and the photosensitive drum 1*a* are in contact with each other, and a toner image corresponding to a yellow image component is formed on the photosensitive drum 1*a*.

Then, the yellow toner image borne on the photosensitive drum 1*a* reaches a primary transfer portion N1*a* where the photosensitive drum 1*a* and the intermediate transfer belt 13 come into contact with each other in accordance with the rotation of the photosensitive drum 1*a*. Then, a voltage with positive polarity is applied from the primary transfer power source 22*a* to the primary transfer roller 10*a*, by which the yellow toner image is primarily transferred from the photosensitive drum 1*a* onto the intermediate transfer belt 13 at the primary transfer portion N1*a*.

Similarly, a magenta toner image of a second color, a cyan toner image of a third color, and a black toner image of a fourth color are formed by the second, third, and fourth image forming units b, c, and d, and are primarily transferred while being sequentially superimposed on the intermediate transfer belt 13. As a result, the toner images of the four colors corresponding to an intended color image are formed on the intermediate transfer belt 13. Then, the toner images of the four colors borne on the intermediate transfer belt 13 are collectively secondarily transferred onto a surface of a transfer material P such as paper and an overhead projector (OHP) sheet in the course of passing through a secondary transfer portion N2 that the secondary transfer roller 25 and the intermediate transfer belt 13 form by contacting each other. At this time, a voltage with positive polarity is applied from the secondary transfer power source 26 to the secondary transfer roller 25, by which the toner images are secondarily transferred from the intermediate transfer belt 13 onto the transfer material P at the secondary transfer portion N2.

The transfer material P is contained in a sheet feeding cassette 16, and is conveyed toward the secondary transfer portion N2 by a conveyance roller 18 after being fed by a sheet feeding roller 17 from the sheet feeding cassette 16 toward the conveyance roller 18. Then, the transfer material P with the toner images of the four colors transferred thereon at the secondary transfer portion N2 is subjected to application of heat and pressure at the fixing unit 50, by which the four colors of toner are fixed onto the transfer material P by being melted and mixed. After that, the transfer material P is discharged from the image forming apparatus 100, and is stacked on a sheet discharge tray 52 serving as a stacking unit.

Transfer residual toner remaining on the intermediate transfer belt 13 after the secondary transfer is removed from a surface of the intermediate transfer belt 13 by a belt cleaning unit 30 (a collection unit) provided so as to face the counter roller 15 via the intermediate transfer belt 13. As will be described in detail below, the belt cleaning unit 30 includes a cleaning blade 31 (an abutment member) in abutment with the outer peripheral surface of the intermediate transfer belt 13 at a position facing the counter roller 15.

The image forming apparatus 100 according to the present example embodiment forms a full-color printed image by this operation.

The image forming apparatus 100 according to the present example embodiment includes a control board (not illustrated) equipped with an electric circuit for controlling an operation of each of the units of the image forming apparatus 100. A central processing unit (CPU) (not illustrated) as the control unit, a memory (not illustrated) as a storage unit storing various kinds of control information therein, and the like are mounted on the control board. The CPU performs, for example, control regarding the conveyance of the transfer material P, control regarding the driving of the intermediate transfer belt 13 and the process cartridge 9, control regarding the image formation, and further, control regarding detection of a failure.

[Example Belt Cleaning Unit]

Figure 2A:
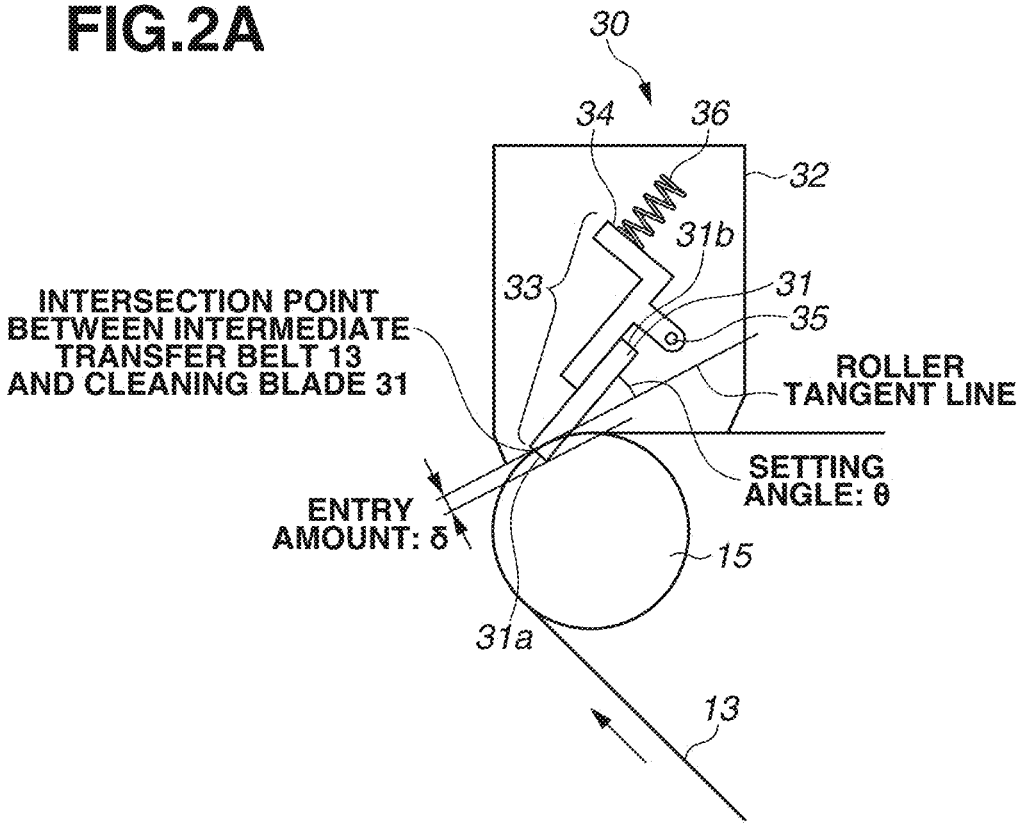
FIGS. 2A and 2B are schematic cross-sectional views around an example belt cleaning unit according to the first example embodiment.
Figure 2B:
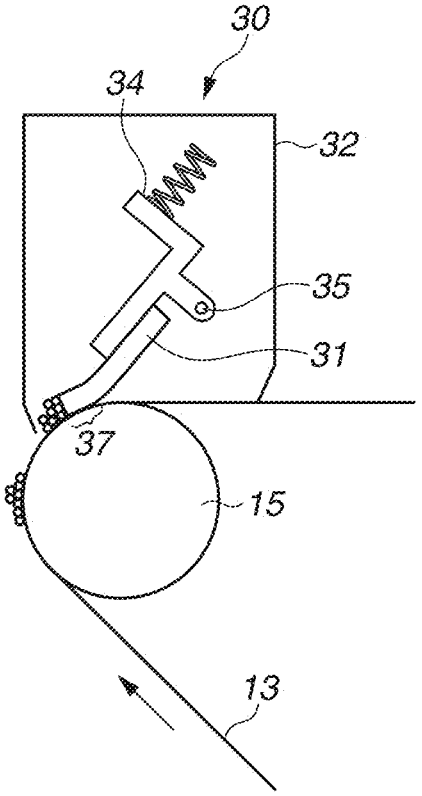

Next, a configuration of the belt cleaning unit 30 will be described. FIG. 2A is an imaginary cross-sectional view illustrating a position at which the cleaning blade 31 is installed when the cleaning blade 31, which will be described below, is not elastically deformed. FIG. 2B is a schematic cross-sectional view illustrating the configuration of the belt cleaning unit 30.

The belt cleaning unit 30 includes a cleaning container 32 and a cleaning action unit 33 provided inside the cleaning container 32. The cleaning container 32 is constructed as a part of a frame member of an intermediate transfer unit (not illustrated) including the intermediate transfer belt 13 and the like. The cleaning action unit 33 includes the cleaning blade 31 as a cleaning member (the abutment member) and a support member 34 supporting the cleaning blade 31. The cleaning blade 31 is an elastic blade made of urethane rubber (polyurethane), which is an elastic material, and is supported in a state adhered to the support member 34 formed with use of a metal plate made of a plated steel plate as a material thereof.

The cleaning blade 31 is a plate-like member elongated in a width direction of the intermediate transfer belt 13 (a longitudinal direction of the cleaning blade 31) that intersects with a movement direction of the intermediate transfer belt 13 (hereinafter referred to as a belt conveyance direction). Further, the cleaning blade 31 is in abutment with the intermediate transfer belt 13 at an end portion 31*a* on a free end side thereof and is fixed in the state adhered to the support member 34 at an end portion 31*b* on a fixed end side thereof in a lateral direction. This cleaning blade 31 is 230 mm in length in the longitudinal direction, 2 mm in thickness, and 77 degrees in hardness as measured according to the Japanese Industrial Standards (JIS) K 6253 standard.

The cleaning action unit 33 is configured swingably relative to the surface of the intermediate transfer belt 13. More specifically, the support member 34 is supported swingably relative to the surface of the intermediate transfer belt 13 via a swing shaft 35 fixed to the cleaning container 32. A pressure is applied to the support member 34 by a pressure spring 36 as a biasing unit provided in the cleaning container 32, which allows the cleaning action unit 33 to move about the swing shaft 35 and causes the cleaning blade 31 to be biased (pressed) to the intermediate transfer belt 13.

The counter roller 15 is disposed on the inner peripheral side of the intermediate transfer belt 13 so as to face the cleaning blade 31. The cleaning blade 31 is in abutment with the surface of the intermediate transfer belt 13 in the counter direction with respect to the belt conveyance direction at a position facing the counter roller 15. More specifically, the cleaning blade 31 is in abutment with the surface of the intermediate transfer belt 13 in such a manner that the end portion 31*a* on the free end side in the lateral direction thereof is oriented toward an upstream side in the belt conveyance direction. As a result, a blade nip portion 37 is formed between the cleaning blade 31 and the intermediate transfer belt 13 as illustrated in FIG. 2B. The cleaning blade 31 rakes up the transfer residual toner from the surface of the moving intermediate transfer belt 13 at the blade nip portion 37, and collects it into the cleaning container 32.

In the present example embodiment, the position at which the cleaning blade 31 is installed is set in the following manner. As illustrated in FIG. 2A, a setting angle θ, an entry amount δ, and an abutment pressure are 22 degrees, 1.3 mm, and 0.6 N/cm, respectively. Here, the setting angle θ refers to an angle formed between a tangent line of the counter roller 15 at an intersection point between the intermediate transfer belt 13 and the cleaning blade 31 (more specifically, an end surface of a free end side thereof), and the cleaning blade 31 (more specifically, one of surfaces substantially perpendicular to a thickness direction thereof). Further, the entry amount δ refers to a length in the thickness direction over which the cleaning blade 31 overlaps the counter roller 15. Further, the abutment pressure is defined by a pressing force (a linear pressure in the longitudinal direction) from the cleaning blade 31 at the blade nip portion 37, and is measured with use of a film pressure force measurement system (trade name: PINCH, manufactured by NITTA Corporation). Setting the installation position in this manner can prevent or reduce a curl and slip noise of the cleaning blade 31 under a high-temperature and high-humidity environment, thereby achieving an excellent cleaning performance. Further, setting the installation position in this manner can prevent or reduce a cleaning failure under a low-temperature and low-humidity environment, thereby achieving an excellent cleaning performance.

Further, urethane rubber and synthetic resin generally generate a large friction resistance due to a sliding movement therebetween, thereby making the cleaning blade 31 liable to being folded over at an early stage. Therefore, an initial lubricant, such as graphite fluoride, can be applied to the end portion 31*a* on the free end side of the cleaning blade 31 in advance.

The rubber hardness of the cleaning blade 31 desirably falls within a range of 70 degrees or higher and 80 degrees or lower as measured in accordance with the JIS K6253 standard, although being appropriately selected according to the material of the intermediate transfer belt 13 and the like. A lower rubber hardness than the above-described range may lead to an increase in a wear amount due to use and thus result in a reduction in durability, while a higher rubber hardness than the above-described range may lead to a reduction in an elastic force and thus cause a chip or the like due to the friction with the intermediate transfer belt 13. Further, the abutment pressure of the cleaning blade 31 desirably falls within a range of 0.4 N/cm or higher and 0.8 N/cm or lower, although being appropriately selected according to the material of the intermediate transfer belt 13 and the like. A lower abutment pressure than the above-described range may lead to a failure to acquire the excellent cleaning performance, while a higher abutment pressure than the above-described range may lead to an excessive increase in a load for rotationally driving the intermediate transfer belt 13.

[Example Intermediate Transfer Belt]

Figure 3A:
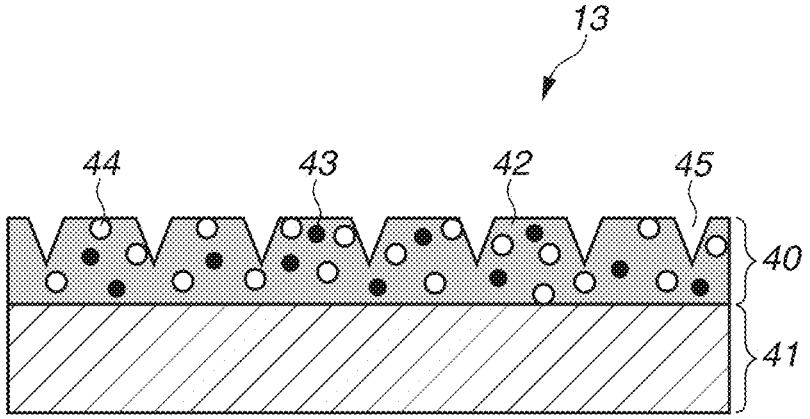
FIGS. 3A and 3B are schematic views illustrating an example configuration of an intermediate transfer belt according to the first example embodiment.
Figure 3B:
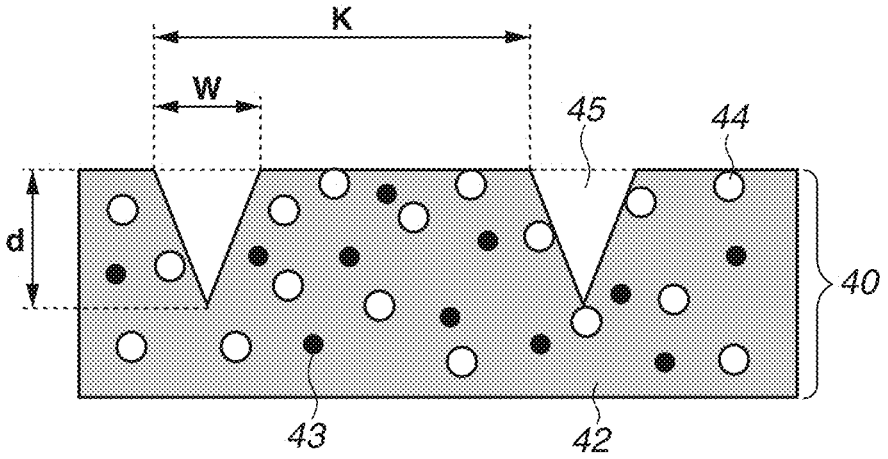

Next, a configuration of the intermediate transfer belt 13 according to the present example embodiment will be described. FIG. 3A is a schematic cross-sectional view of an enlarged portion of the intermediate transfer belt 13 taken along a direction substantially perpendicular to the belt conveyance direction (as viewed along the belt conveyance direction), and FIG. 3B illustrates further details of a surface layer 40 of the intermediate transfer belt 13, which will be described below, in a similar cross section.

The intermediate transfer belt 13 is an endless belt member (or a film-like member) including two layers, namely, a base layer 41 and the surface layer 40, and has a circumferential length of 790 mm. Now, the base layer is defined to be the thickest layer of the layers forming the intermediate transfer belt 13 in a thickness direction of the intermediate transfer belt 13. In the present example embodiment, the base layer 41 is a layer 70 μm in thickness that is formed by dispersing quaternary ammonium salt, which is an ion conductive agent, into polyethylene naphthalate resin as an agent for adjusting an electric resistance. Further, the surface layer 40 is a layer formed on the outer peripheral side of the intermediate transfer belt 13, and formed by dispersing antimony-doped zinc oxide as an electric resistance adjustment agent 43 and adding polytetrafluoroethylene (PTFE) particles as a solid lubricant 44 into acrylic resin as a base material 42. In the present example embodiment, a thickness of the surface layer 40 is set to 3 μm.

A volume resistivity of the intermediate transfer belt 13 according to the present example embodiment is $1\times10^{10}$ Ω·cm under a measurement environment of 23 degrees Celsius (° C.) in temperature and 50% in relative humidity with use of Hiresta•UP MCP-HT450 (manufactured by Mitsubishi Chemical Corporation). Desirably, the volume resistivity of the intermediate transfer belt 13 falls within a range of $10^9$ to $10^{12}$ Ω·cm from the viewpoint of achieving excellent image formation.

Further, the materials of the base layer 41 and the surface layer 40 are not limited to the above-described examples, and may be other materials. Besides the polyethylene naphthalate resin, examples employable as the material of the base layer 41 also include thermoplastic resin such as polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polyphenylene sulfide, polyethersulfone, polyether nitrile, thermoplastic polyimide, polyether ether ketone, thermotropic liquid crystal polymer, and polyamide acid. Two or more materials of them can also be used by being mixed together.

The surface layer 40 can also be made from a material other than the acrylic resin, such as curable resin including melamine resin, urethane resin, alkyd resin, and fluorine-based curable resin (fluorine-containing curable resin), in a case of an organic material. The surface layer 40 can also be made from an alkoxysilane/alkoxyzirconium-based material, a silicate-based material, or the like in a case of an inorganic material. The surface layer 40 can also be made from an inorganic fine particles-dispersed organic polymeric material, an inorganic fine particles-dispersed organoalkoxysilane-based material, an acrylic silicone-based material, an organoalkoxysilane-based material, or the like in a case of an organic/inorganic hybrid material.

From the viewpoint of strength such as an anti-wear property and an anti-crack property of the surface layer 40 of the intermediate transfer belt 13, a resin material (curable resin) is desirable among curable materials, and acrylic resin acquired by curing an unsaturated double bond-containing acrylic copolymer is desirable among curable resin materials. In the present example embodiment, the surface layer 40 of the intermediate transfer belt 13 is acquired by applying liquid containing an ultraviolet curable monomer and/or oligomer component to a surface of the base layer 41 and irradiating it with an energy line such as ultraviolet to cure it.

Examples of an electron conductive material include a carbon-based electron conductive filler in the form of particles, fibers, or flakes, such as carbon black, polyacrylonitrile (PAN)-based carbon fibers, and an expanded graphite pulverized product. Further, the examples thereof also include a metallic conductive filler in the form of particles, fibers, or flakes, such as silver, nickel, copper, zinc, aluminum, stainless steel, and iron. Further, the examples thereof also include a metal oxide-based conductive filler in the form of particles, such as zinc antimonate, antimony-doped tin oxide, antimony-doped zinc oxide, tin-doped indium oxide, and aluminum-doped zinc oxide. Examples of an ion conductive material include ionic liquid, conductive oligomer, and quaternary ammonium salt. One or more kinds of materials may be appropriately selected from these conductive materials, and the electron conductive material and the ion conductive material may be used in mixture.

Further, as illustrated in FIGS. 3A and 3B, in the present example embodiment, the surface layer 40 is subjected to surface treatment processing and includes grooves (groove shapes or grooved portions) 45 formed along the belt conveyance direction to reduce the wear of the cleaning blade 31.

In the configuration that removes the transfer residual toner to clean the intermediate transfer belt by bringing the abutment member such as the cleaning blade into abutment with the intermediate transfer belt with the solid lubricant added in the surface material, the solid lubricant on the surface tends to be scraped off by the cleaning blade and be deposited on the blade nip portion. The intermediate transfer belt 13 with the groove shapes formed on the surface layer 40 thereof, like the present example embodiment, exhibits this tendency especially noticeably, because a surface area of the intermediate transfer belt 13 increases and therefore an exposed area of the solid lubricant 44 (PTFE in the present example embodiment) increases. If the solid lubricant 44 is excessively deposited on the blade nip portion 37, a part of the deposited solid lubricant 44 may be detached from the blade nip portion 37 and form a tunnel-like space at the blade nip portion 37. As a result, a cleaning failure may occur as the toner undesirably easily passes through via the tunnel-like space.

Therefore, the present example embodiment is characterized in that the configuration with the solid lubricant 44 added in the surface layer 40 of the intermediate transfer belt 13 includes the groove shapes provided on the surface layer 40 in such a manner that a height of the solid lubricant 44 deposited at the blade nip portion 37 falls below an average particle diameter of the toner. The height of the solid lubricant 44 refers to a distance from a surface of the surface layer 40 with no groove formed thereon to a surface of the cleaning blade 31 facing the surface layer 40 at the blade nip portion 37 in the thickness direction of the intermediate transfer belt 13. Details thereof will be described below.

The average particle diameter of the toner was measured with use of Coulter Multisizer II (manufactured by Coulter Corporation). Data was analyzed by connecting, to Coulter Multisizer II, an interface (manufactured by Nikkaki Bios Company Limited) for outputting a number distribution and a volume distribution, and a personal computer. A 1%-sodium chloride (NaCl) aqueous solution prepared with use of primary sodium chloride was used as an electrolytic solution used in the measurement. As such an electrolytic solution, for example, ISOTON R-II (manufactured by Coulter Scientific Japan Corporation) can be used. This measurement was carried out by the following method. A surfactant, desirably alkylbenzenesulfonic acid salt, was added by 0.1 to 5 ml into the above-described electrolytic solution of 100 to 150 ml as a dispersant, and a measurement sample was further added by 2 to 20 mg thereto. Then, the electrolytic solution with the sample added therein was subjected to dispersion processing with use of an ultrasonic disperser for approximately 1 to 3 minutes. Then, the volume distribution and the number distribution were calculated by measuring a volume and the number of toner particles 2 μm or larger in particle diameter with use of the above-described device, Coulter Multisizer with a 100-μm aperture employed as an aperture. A weight-average particle diameter based on the weight was calculated with use of these values, and this value was determined to be the average particle diameter of the toner. In the present example embodiment, the average particle diameter D of the toner was 6 μm.

As illustrated in FIG. 3B, 1 μm is set as a width W of an opening portion of each of the grooves 45 in a direction (the width direction of the intermediate transfer belt 13) substantially orthogonal to the longitudinal axial direction (hereinafter simply referred to as the width W). Further, 2 μm is set as a depth d from the surface of the surface layer 40 with no groove formed thereon (an opening portion) to a bottom portion of the groove 45 in the thickness direction of the intermediate transfer belt 13 (hereinafter simply referred to as the depth d). Further, 20 μm is set as a pitch K of the groove 45 in the direction substantially orthogonal to the belt conveyance direction (hereinafter simply referred to as the pitch K).

Desirably, the width W of the groove 45 is a width up to approximately half the average particle diameter of the toner from the viewpoint of the cleaning performance. An excessively wide width W of the groove 45 may lead to an unintended escape of the toner from the blade nip portion 37 when the toner is accidentally stuck in the groove 45, thereby resulting in occurrence of a cleaning failure. On the other hand, an excessively narrow width W of the groove 45 may lead to an excessive increase in a contact area between the cleaning blade 31 and the intermediate transfer belt 13 and thus an increase in the friction at the blade nip portion 37, thereby undesirably facilitating the wear at the distal end of the cleaning blade 31. Therefore, in the configuration according to the present example embodiment, the width W of the groove 45 can be set to 0.5 μm or wider and 3 μm or narrower.

In the present example embodiment, since the thickness of the surface layer 40 is 3 μm, the groove 45 extends only in the surface layer 40 without reaching as far as the base layer 41. Further, the groove 45 is continuously formed throughout an entire range of a whole circumference of the intermediate transfer belt 13 along a circumferential direction of the intermediate transfer belt 13 (a rotational direction). In the present example embodiment, the groove shape is provided to the surface of the intermediate transfer belt 13 by pressing a die having a protruding shape formed on a surface thereof against the surface layer 40.

The thickness of the surface layer 40 should be a thickness that allows the groove 45 to be formed thereon, i.e., a thickness equal to or thicker than the depth d of the groove 45. A thinner thickness of the surface layer 40 than the depth d of the groove 45 may cause the groove 45 to reach the base layer 41 and a substance added in the base layer 41 to be unintentionally extracted on the surface of the surface layer 40, thereby resulting in occurrence of a cleaning failure or the like. On the other hand, an excessively thick thickness of the surface layer 40 may cause the surface layer 40 made from the acyclic resin to be accidentally cracked, thereby resulting in occurrence of a cleaning failure. Therefore, in the configuration according to the present example embodiment, the thickness of the surface layer 40 is desirably set between 1 μm or thicker and 5 μm or thinner, and is more desirably set between 1 μm or thicker and 3 μm or thinner in consideration of the crack of the surface layer 40 over long-term use.

[Example Evaluation of Cleaning Performance]

Figure 4A:
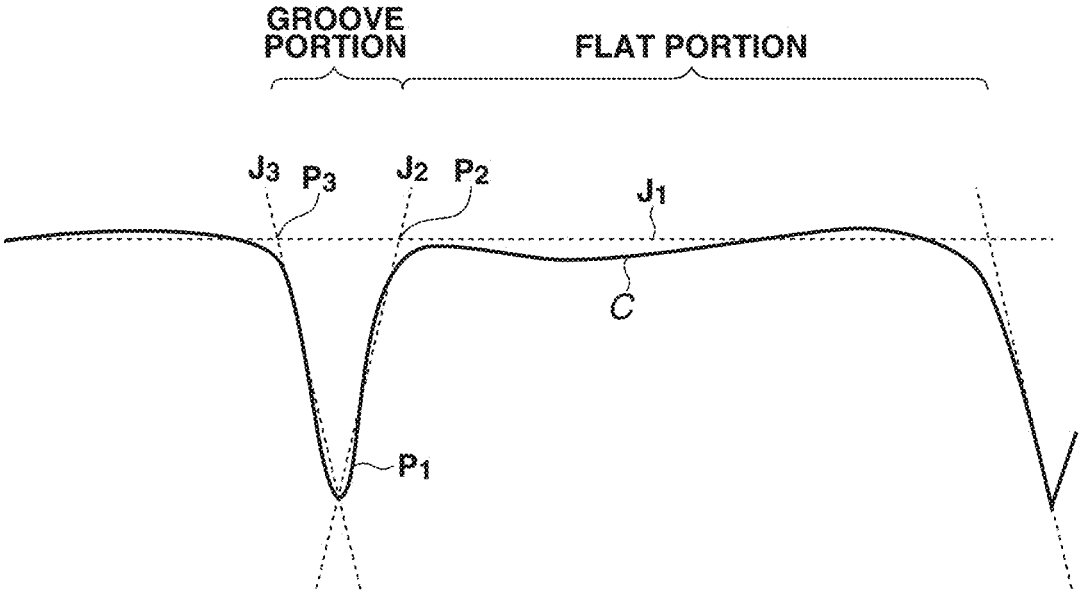
FIGS. 4A and 4B are schematic views illustrating an approximate cross-sectional shape of a groove of the intermediate transfer belt according to the first example embodiment.
Figure 4B:
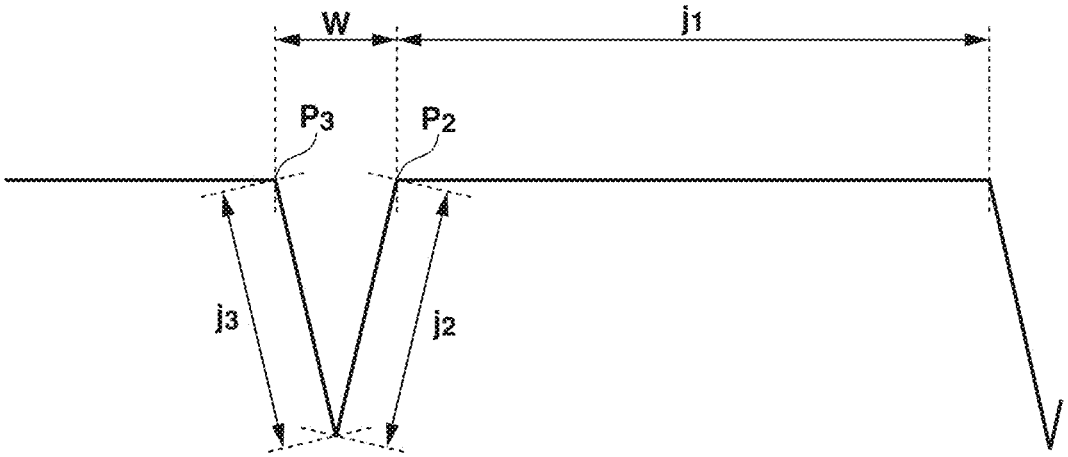

FIG. 4A illustrates a cross-sectional profile of the groove shape of the intermediate transfer belt 13 according to the present example embodiment. FIG. 4B illustrates an approximate cross-sectional shape of the groove 45 formed on the intermediate transfer belt 13 according to the present example embodiment that was acquired from the cross-sectional profile.

The cross-sectional profile of the groove shape was measured with use of L-trace and NanoNavi II (manufactured by SII Nano Technology Incorporated). A high-aspect probe, SI-40H was used as a cantilever. A dynamic force microscope (DFM) mode was employed for the measurement, and a shape image was measured in a measurement range of 50 μm square. An approximate shape was calculated from a measured cross-sectional profile C. In the present example embodiment, the approximate cross-sectional shape was acquired by approximating the flat portion without the groove 45 formed thereon by a straight line $J_1$ and approximating side walls of the groove portion on both sides of the groove 45 by straight lines $J_2$ and $J_3$. The straight lines $J_2$ and $J_3$ of the side walls were assumed to intersect with each other at a point $P_1$, which was the deepest portion of the groove 45. Points $P_2$ and $P_3$ were set to represent intersection points between the straight lines $J_2$ and $J_3$ of the side walls and the straight line $J_1$ of the flat portion, respectively. As illustrated in FIG. 4B, $j_1$, $j_2$, and $j_3$ were set to represent distances of respective line segments of the straight line $J_1$, the straight line $J_2$, and the straight line $J_3$, respectively. Further, the cross-sectional profile of the intermediate transfer belt 13 was measured at arbitrary five points on the intermediate transfer belt 13, and an average approximate shape thereof was calculated and defined as the groove shape. In the present example embodiment, since the pitch K of the groove 45 was 20 μm, the measurement range was set to 50 μm square. However, this measurement range may be appropriately set so as to allow the above-described straight lines and intersection points to be acquired according to the value of the pitch K of the groove 45.

In the following description, the above-described effects will be described in detail with use of the present example embodiment, example modifications of the present example embodiment, and comparative examples. First to sixth example modifications are used as the example modifications, and first to fifth comparative examples are used as the comparative examples. Except for differences in the pitch K of the groove shape formed on the surface of the intermediate transfer belt 13 and a contained amount (an added amount) of the PTFE particles used as the solid lubricant 44, the individual example modifications and comparative examples are substantially similar to one another in terms of the other configurations. Table 1, which will be described below, indicates the pitch K and the contained amount of the PTFE particles in each of the example modifications and the comparative examples.

As an evaluation of the cleaning performance, an image for confirming whether a cleaning failure occurred was formed every five thousand sheets in a durability evaluation in which text images were formed at 1% for each color in a two-sheet intermittent mode with use of sheets having an A4 size and a grammage of 80 g/m$^2$ (Red Label/manufactured by Oce Company). The evaluation was conducted under an environment of a temperature set to 23° C. and a humidity set to 50% and under conditions of a process speed set to 200 mm/sec (a throughput: 40 sheets per minute) and an image forming mode for printing plain paper.

Whether the cleaning failure occurred was confirmed for every five thousand sheets in the above-described durability evaluation with use of the following method. First, after a red solid image (a solid image with yellow at 100% and magenta at 100%) was formed with the output from the secondary transfer power source 26 turned off (0 V), three transfer materials P were continuously fed through the image forming apparatus 100 without forming an image thereon with the output from the secondary transfer power source 26 set to a normal value. More specifically, whether the cleaning failure occurred was confirmed by checking whether the toner of the red solid image remaining almost without being transferred onto the transfer material P at the secondary transfer portion N2 was able to be removed by the cleaning blade 31.

If the toner of the red solid image is removed from the intermediate transfer belt 13, the three transfer materials P continuously fed through the image forming apparatus 100 would be output substantially in a completely blank state. On the other hand, if the toner of the red solid image is not removed, the toner having escaped from the cleaning blade 31 would reach the secondary transfer portion N2 again to be transferred onto the three transfer materials P continuously fed through the image forming apparatus 100, and end up being output as cleaning failure images. Whether the cleaning failure occurred was confirmed in this manner every time five thousand transfer materials P were fed through the image forming apparatus 100, and the result thereof was evaluated as "pass" if the cleaning failure image was not output and as "fail" if the cleaning failure image was output after one hundred thousand transfer materials P were fed through the image forming apparatus 100.

Further, the height of the solid lubricant 44 deposited on the abutment nip of the cleaning blade 31 when the cleaning failure had occurred was measured for a configuration in which the cleaning failure had occurred before the image forming apparatus 100 finished feeding the one hundred thousand transfer materials P therethrough. The height of the solid lubricant 44 when the image forming apparatus 100 finished feeding the one hundred thousand transfer materials P therethrough was measured for a configuration in which the cleaning failure had not occurred even when the image forming apparatus 100 finished feeding the one hundred thousand transfer materials P therethrough.

Figure 5A:
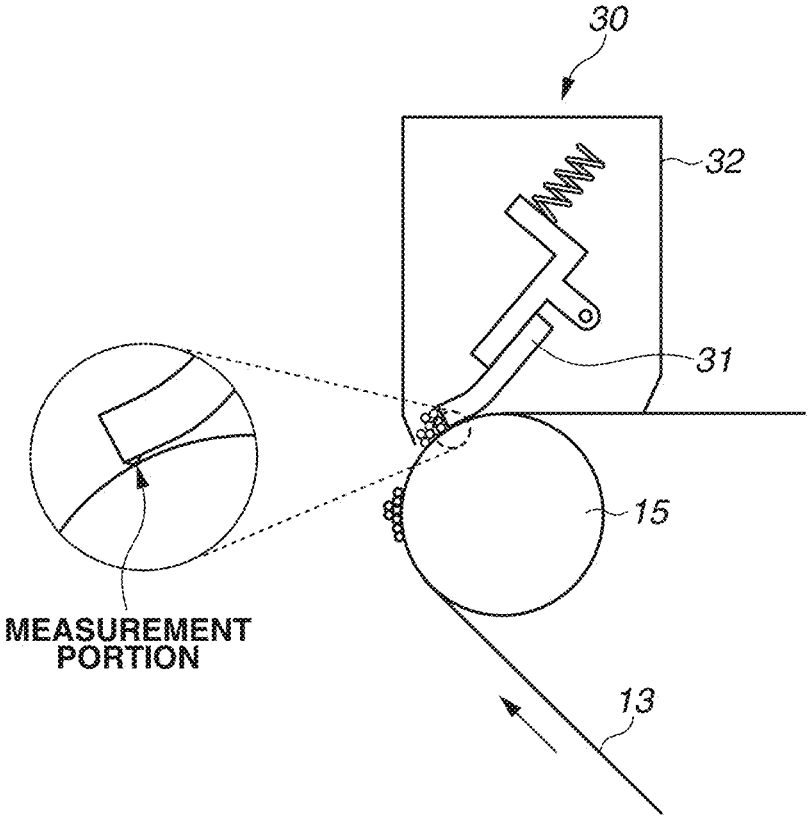
FIGS. 5A and 5B are schematic views illustrating a position at which a height of a solid lubricant deposited at a distal end of a cleaning blade was measured according to the first example embodiment.
Figure 5B:
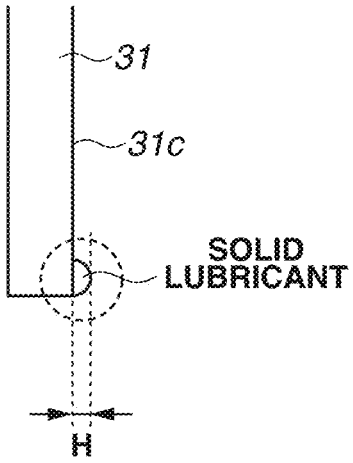

FIG. 5A illustrates a position at which the height of the solid lubricant 44 on the cleaning blade 31 was measured. The height of the solid lubricant 44 was measured by releasing the abutment state of the cleaning blade 31 with the intermediate transfer belt 13 and observing the cleaning blade 31 alone with use of a microscope. The measurement position was located in a region indicated by a dotted line in FIG. 5A. FIG. 5B is a schematic view of the solid lubricant 44 deposited on the cleaning blade 31. The microscope used in the measurement was a confocal microscope (OPTELICS, manufactured by Lasertec Corporation). The height of the solid lubricant 44 was measured with an observation region set to 100 μm square, a measurement wavelength set to 546 nm, and a scanning frequency set to 0.1 μm in a direction perpendicular to the abutment position of the cleaning blade 31. A value of the height H of the solid lubricant 44 used in the following evaluation was a maximum value in the longitudinal direction of the cleaning blade 31.

As illustrated in FIG. 5A, the height H of the solid lubricant 44 was a distance from an abutment surface 31*c* on which the cleaning blade 31 was in abutment with the intermediate transfer belt 13 to the outer peripheral surface (the surface) of the intermediate transfer belt 13. In the evaluation method according to the present example embodiment, as illustrated in FIG. 5B, the height H of the solid lubricant 44 was the thickness of the solid lubricant 44 deposited from the abutment surface 31*c* of the cleaning blade 31 in a direction toward the intermediate transfer belt 13.

Further, in the evaluation according to the present example embodiment, a wear amount at the end portion 31*a* (the distal end portion) of the cleaning blade 31 when the cleaning failure had occurred was measured for the configuration in which the cleaning failure had occurred before the image forming apparatus 100 finished feeding the one hundred thousand transfer materials P therethrough. A wear amount at the end portion 31*a* of the cleaning blade 31 when the image forming apparatus 100 finished feeding the one hundred thousand transfer materials P therethrough was measured for the configuration in which the cleaning failure had not occurred even when the image forming apparatus 100 finished feeding the one hundred thousand transfer materials P therethrough.

The wear amount was measured by releasing the abutment state of the cleaning blade 31 with the intermediate transfer belt 13 and observing the cleaning blade 31 alone with use of a microscope. The microscope used in the measurement was a confocal microscope (OPTELICS, manufactured by Lasertec Corporation). The wear amount was measured with an observation region set to 10 μm square, a measurement wavelength set to 546 nm, and a scanning frequency set to 0.1 μm in the direction perpendicular to the abutment position of the cleaning blade 31. Based on such a measurement, the wear of the blade was evaluated as "fail" if the wear amount exceeded the average particle diameter of the toner and as "pass" if the wear amount did not exceed the average particle diameter of the toner. Table 1 indicates the results of the above-described evaluations.

TABLE 1

| Configuration | Pitch K (μm) | Contained Amount of PTFE Particles (Parts by Weight) | Height H (μm) | Wear of Blade | Cleaning Performance |
|---|---|---|---|---|---|
| First Example Embodiment | 20 | 30 | 3.0 | Pass | Pass |
| First Example Modification | 20 | 50 | 5.7 | Pass | Pass |
| Second Example Modification | 20 | 60 | 5.5 | Pass | Pass |
| First Comparative Example | 20 | 70 | 6.5 | Pass | Fail |
| Second Comparative Example | 20 | 0 | 0.0 | Fail | Fail |
| Third Example Modification | 10 | 40 | 4.0 | Pass | Pass |
| Fourth Example Modification | 10 | 50 | 5.8 | Pass | Pass |
| Third Comparative Example | 10 | 60 | 6.1 | Pass | Fail |
| Fifth Example Modification | 3 | 20 | 4.5 | Pass | Pass |
| Sixth Example Modification | 3 | 30 | 5.5 | Pass | Pass |
| Fourth Comparative Example | 3 | 40 | 6.8 | Pass | Fail |
| Fifth Comparative Example | 3 | 0 | 0.0 | Fail | Fail |

As indicated in Table 1, the configuration according to the first example embodiment did not lead to generation of the cleaning failure image after the durability evaluation in which the one hundred thousand transfer materials P were fed through the image forming apparatus 100, and also resulted in an excellent wear state of the cleaning blade 31. The first example modification, the second example modification, the third example modification, the fourth example modification, the fifth example modification, and the sixth example modification also did not lead to generation of the cleaning failure image after the durability evaluation similarly to the first example embodiment, and was also free from wear equal to or larger than 6 μm, which was the average particle diameter of the toner, regarding the wear of the cleaning blade 31. Further, the first example embodiment and the first to sixth example modifications allowed the height H of the solid lubricant 44 after the durability evaluation to fall below 6 μm, which was the average particle diameter of the toner.

The configurations according to the first comparative example, the third comparative example, and the fourth comparative example led to generation of the cleaning failure image before the image forming apparatus 100 finished feeding the one hundred thousand transfer materials P therethrough. However, the wear state was excellent, as the wear amount at the distal end position of the cleaning blade 31 when the cleaning failure image was generated was equal to or smaller than 6 μm, which was the average particle diameter of the toner.

The configurations according to the second comparative example and the fifth comparative example led to generation of the cleaning failure image before the image forming apparatus 100 finished feeding the one hundred thousand transfer materials P therethrough. Further, the wear amount at the distal end position of the cleaning blade 31 when the cleaning failure image was generated was equal to or larger than 6 μm, which was the average particle diameter of the toner. This is considered to be attributed to presence of a strong frictional force between the cleaning blade 31 and the intermediate transfer belt 13.

Table 2 is generated based on the results indicated in Table 1, and indicates a relationship between the height H of the solid lubricant 44 and the cleaning performance, where P represents pass and F represents fail.

TABLE 2

| | Height H (μm) | | | | | | | | | | |
|---|---|---|---|---|---|---|---|---|---|---|---|
| | 0.0 | 3.0 | 4.0 | 4.5 | 5.5 | 5.5 | 5.7 | 5.8 | 6.1 | 6.8 | 8.0 |
| Cleaning Performance | F | P | P | P | P | P | P | P | F | F | F |

As indicated in Table 1 and Table 2, the configurations in which the height H of the solid lubricant 44 was equal to or higher than 6 μm, which was the average particle diameter of the toner, led to continuous occurrence of a streaky cleaning failure due to detachment of the solid lubricant 44 on some portion in the longitudinal direction of the cleaning blade 31. On the other hand, the configurations in which the height H of the solid lubricant 44 was lower than 6 μm, which was the average particle diameter of the toner, did not lead to occurrence of a cleaning failure on an unallowable level.

When the height H of the solid lubricant 44 was lower than 6 μm, most of the toner was collected by the cleaning blade 31 even with the deposited solid lubricant 44 detached on some portion in the longitudinal direction of the cleaning blade 31. At this time, a part of the toner on a small particle diameter side in a toner granularity distribution might escape via the detachment position, but the cleaning failure on the unallowable level had not occurred because the toner collected by the cleaning blade 31 closed the position at which the solid lubricant 44 was detached.

Figure 6:
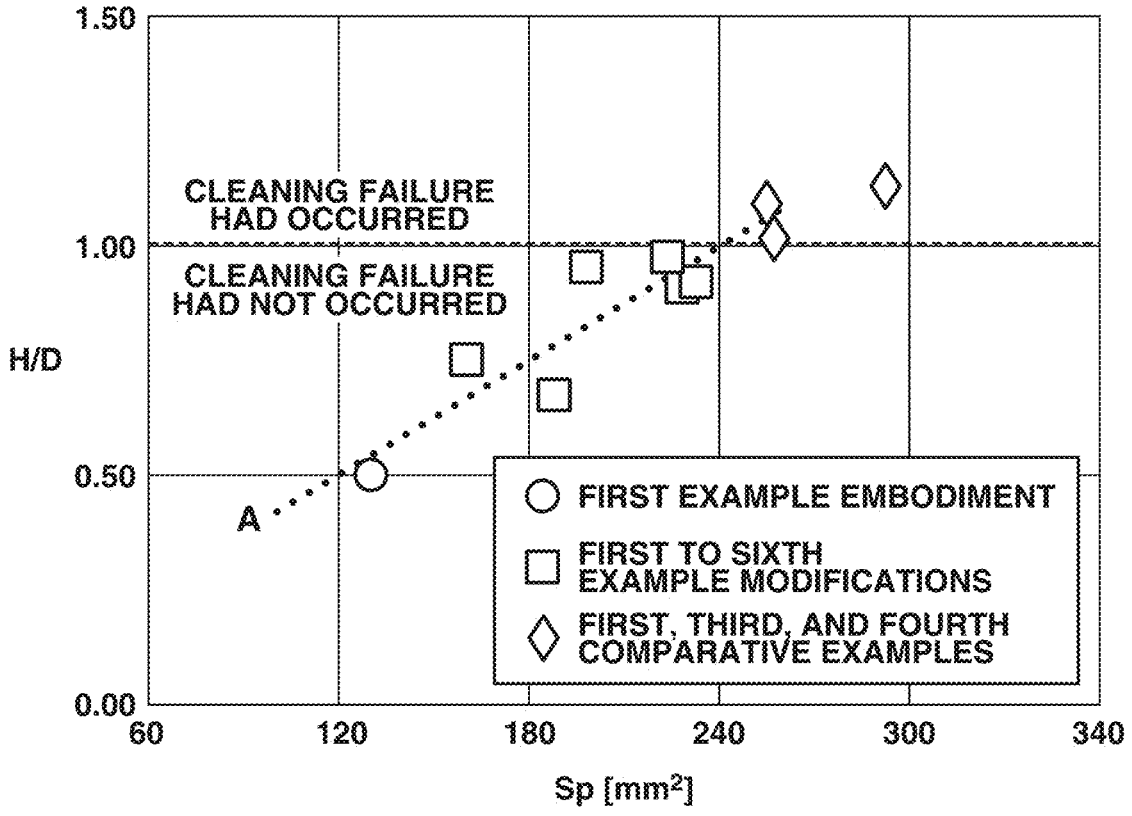
FIG. 6 is a graph illustrating a relationship between a surface area of the solid lubricant and the height of the solid lubricant deposited on the cleaning blade according to the first example embodiment.

FIG. 6 is a graph illustrating a relationship between an area $S_P$ of the solid lubricant 44 (the PTFE particles) exposed on the surface of the intermediate transfer belt 13 and the height H of the solid lubricant 44 in each of the configurations evaluated in terms of the cleaning performance in the above-described evaluation. The area $S_P$ of the solid lubricant 44 exposed on the surface of the intermediate transfer belt 13 can be calculated with use of the following formula, formula 1. In formula 1, a cross-sectional length J ($J=J_1+J_2+J_3$) refers to a cross-sectional length per groove 45 that is calculated in FIG. 4, and (1/K) indicates the number of grooves 45 per unit length in the width direction of the intermediate transfer belt 13. Further, in the following formula 1, the area $S_P$ was calculated with use of a circumferential length L of the intermediate transfer belt 13 corresponding to the region where the grooves 45 were formed, a contained amount Q (parts by weight) of the PTFE particles used as the solid lubricant 44, a density $\rho_P$ of PTFE, and a density $\rho_A$ of the acrylic resin forming the surface layer 40.

[Formula 1]

$$S_P=J\times(1/K)\times L\times(Q/\rho_P)/((Q/\rho_P)+(100/\rho_A)) \quad \text{Formula 1}$$

The area $S_P$ per unit length (1 mm in the longitudinal direction in the present example) according to the present example embodiment that was calculated from the above-described formula was approximately 130 $mm^2$. At this time, the area $S_P$ was calculated after all of the units of the cross-sectional length J, the groove pitch K, and the circumferential length L were converted into the same unit, mm.

In FIG. 6, a horizontal axis in the graph represents the area $S_P$ $mm^2$ of the solid lubricant 44, and a vertical axis represents a value acquired by dividing the height H (μm) of the solid lubricant 44 attached to the cleaning blade 31 by the average particle diameter D (μm) of the toner. The graph illustrated in FIG. 6 indicates that the height H of the solid lubricant 44 deposited on the cleaning blade 31 matches or exceeds the average particle diameter D of the toner in a region where H/D is H/D>=1. Further, a line segment A indicated by a dotted line in FIG. 6 is an approximate line of plotted points at which the cleaning performance was evaluated as "pass" without the cleaning failure image generated until the one hundred thousand sheets were fed through the image forming apparatus 100.

As illustrated in FIG. 6, the cleaning failure had occurred in the region where H/D was H/D>=1, and the cleaning failure had not occurred in the region where H/D was H/D<1. Then, the area $S_P$ corresponding to an intersection point between the line segment A and H/D=1 has a value of approximately 240 $mm^2$. This means that the area $S_P$ smaller than 240 $mm^2$ can prevent or reduce the occurrence of the cleaning failure due to the detachment of the solid lubricant 44 deposited on the cleaning blade 31. Therefore, the occurrence of the cleaning failure due to the deposition of the solid lubricant 44 on the distal end of the cleaning blade 31 can be prevented or reduced by satisfying the following formula, formula 2.

[Formula 2]

$$J\times(1/K)\times L\times(Q/\rho_P)/((Q/\rho_P)+(100/\rho_A))<240 \quad \text{Formula 2}$$

Examples of a specific configuration in which the area $S_P$ falls below 240 $mm^2$ in the present example embodiment include a configuration in which the contained amount (a content) of the PTFE particles used as the solid lubricant 44 is 30 parts by weight or less in the case where the groove pitch K is 3 μm. Further, for example, the above-described formula 2 can be satisfied in such configurations that the contained amount of the PTFE particles is 54 parts by weight or less in the case where the groove pitch K is 10 μm, and is 63 parts by weight or less in the case where the groove pitch K is 20 μm.

In the above-described manner, according to the configuration of the present example embodiment, the grooves 45 are formed on the surface layer 40 containing the solid lubricant 44 such as the fluorine-containing particles in such a manner that the height H of the solid lubricant 44 deposited on the distal end of the cleaning blade 31 falls below the average particle diameter D of the toner. Due to this arrangement, the present configuration can prevent or reduce the occurrence of the cleaning failure due to the detachment of the solid lubricant 44 deposited on the distal end of the cleaning blade 31 and thus the escape of the toner through the abutment portion between the cleaning blade 31 and the intermediate transfer belt 13.

Figure 7A:
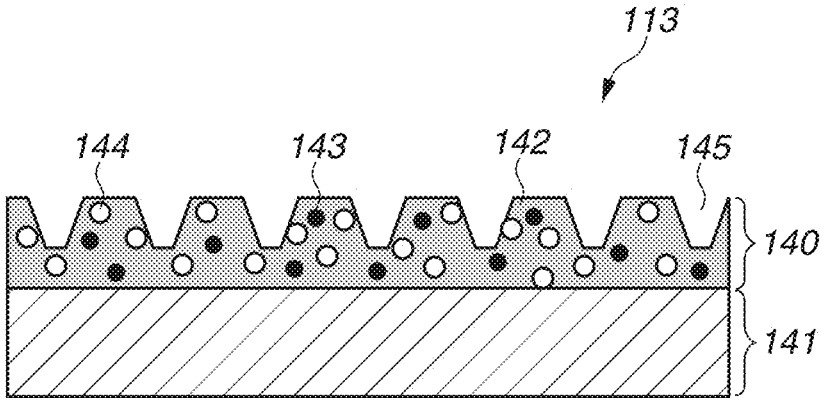
FIGS. 7A and 7B are schematic views illustrating an example configuration of an intermediate transfer belt according to a second example embodiment.
Figure 7B:
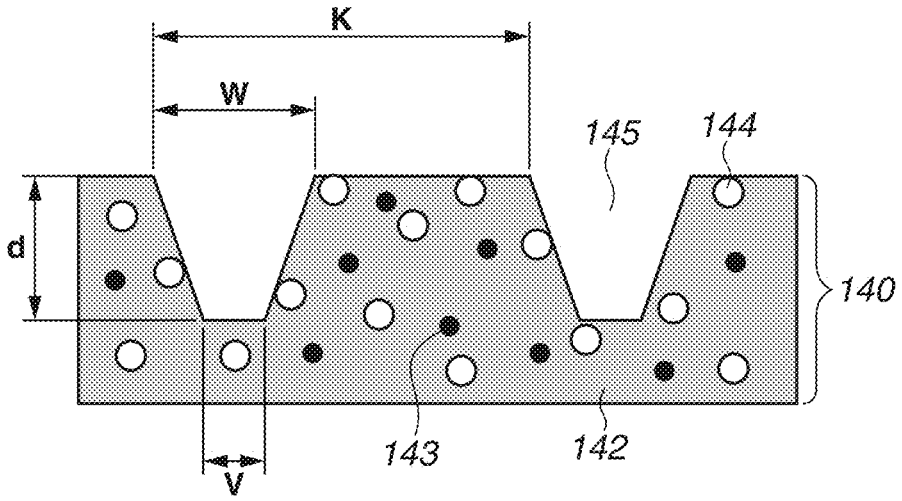

In the first example embodiment, the configuration of the intermediate transfer belt 13 including the grooves 45 provided as illustrated in FIGS. 3A, 3B, 4A, and 4B has been described. On the other hand, in a second example embodiment, a configuration of an intermediate transfer belt 113 including grooves 145 shaped differently from the first example embodiment as illustrated in FIGS. 7A and 7B will be described. The present example embodiment is configured substantially similarly to the first example embodiment except for the difference of the shape of each of the grooves 145 formed on a surface layer 140 of the intermediate transfer belt 113. Therefore, features shared with the first example embodiment will be identified by the same reference numerals, and descriptions thereof will be omitted below.

FIG. 7A is a schematic cross-sectional view of an enlarged portion of the intermediate transfer belt 113 taken along the direction substantially orthogonal to the belt conveyance direction (as viewed along the belt conveyance direction), and FIG. 7B illustrates further details of the surface layer 140 of the intermediate transfer belt 113, which will be described below, in a similar cross section. In the present example embodiment, a change is made to the shape of the die for providing the groove shape to the intermediate transfer belt 113. The width W of the groove 145, a width V of a base of the groove 145, and the depth d are 3 μm, 2 μm, and 2 μm, respectively. Further, the pitch K of the groove 145 is 20 μm.

Figure 8A:
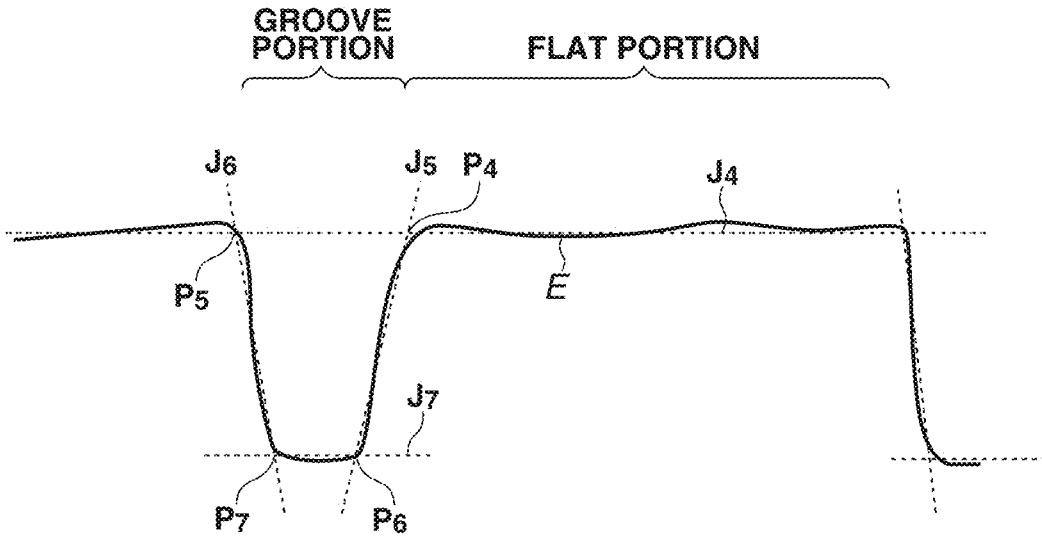
FIGS. 8A and 8B are schematic views illustrating an approximate cross-sectional shape of a groove of the intermediate transfer belt according to the second example embodiment.
Figure 8B:
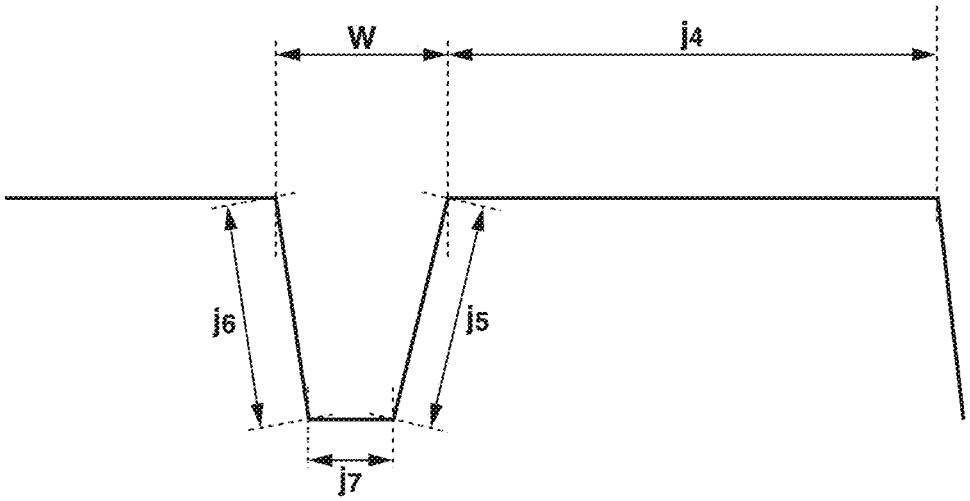

FIG. 8A illustrates a cross-sectional profile E of the groove shape of the intermediate transfer belt 113 according to the present example embodiment. FIG. 8B illustrates an approximate cross-sectional shape of the groove 145 formed on the intermediate transfer belt 113 according to the present example embodiment that was acquired from the cross-sectional profile E. The cross-sectional profile of the groove 145 was measured under the same conditions and with use of the same method as the first example embodiment. In the present example embodiment, as illustrated in FIG. 8B, the approximate cross-sectional shape was acquired by approximating the flat portion without the groove 145 formed thereon by a straight line $J_4$, approximating side walls on both sides of the groove 145 by straight lines $J_5$ and $J_6$, and approximating a bottom portion of the groove 145 by a straight line $J_7$. The straight line $J_7$ of the bottom portion was assumed to extend in parallel with the straight line $J_4$, and a point $P_4$, a point $P_5$, a point $P_6$, and a point $P_7$ were set to represent an intersection point between the straight line $J_4$ and the straight line $J_5$, an intersection point between the straight line $J_4$ and the straight line $J_6$, an intersection point between the straight line $J_7$ and the straight line $J_5$, and an intersection point between the straight line $J_7$ and the straight line $J_6$, respectively. Further, in the present example embodiment, similarly to the first example embodiment, the cross-sectional profile E of the intermediate transfer belt 113 was also measured at arbitrary five points on the intermediate transfer belt 113, and an average approximate shape thereof was also calculated and defined as the groove shape. Further, $j_4$, $j_5$, $j_6$, and $j_7$ were set to represent distances of respective line segments of the straight line $J_4$, the straight line $J_5$, the straight line $J_6$, and the straight line $J_7$, respectively.

An area $S_P$ of the solid lubricant 144 (the PTFE particles) exposed on the surface of the intermediate transfer belt 113 according to the present example embodiment was calculated with use of the formula 1 similarly to the first example embodiment, expressing a cross-sectional length per groove 145 calculated in the above-described manner as $J=J_4+J_5+J_6+J_7$. Then, approximately 130 $mm^2$ was acquired as the area $S_P$ per 1 mm in the longitudinal direction according to the present example embodiment that was calculated from the above-described formula 1, similarly to the first example embodiment.

In the following description, the effects will be described in detail with use of the present example embodiment, a seventh example modification of the present example embodiment, and a sixth comparative example. Except for differences of the pitch K of the groove 145 formed on the surface layer 140 of the intermediate transfer belt 113 and a contained amount (an added amount) of the PTFE particles used as the solid lubricant 144, the seventh example modification and the sixth comparative example are substantially similar in terms of the other configurations. Referring to the following table, Table 3, evaluations of the cleaning performance and the wear of the blade of the cleaning blade 31 were conducted by the same methods as the first example embodiment, and therefore descriptions thereof will be omitted here.

TABLE 3

| Configuration | Pitch K (μm) | Contained Amount of PTFE Particles (Parts by Weight) | Height H (μm) | Wear of Blade | Cleaning Performance |
|---|---|---|---|---|---|
| Second Example Embodiment | 20 | 30 | 3.2 | Pass | Pass |
| Seventh Example Modification | 20 | 50 | 5.5 | Pass | Pass |
| Sixth Comparative Example | 20 | 70 | 6.4 | Pass | Fail |

As indicated in Table 3, the configurations according to the second example embodiment and the seventh example modification did not lead to generation of the cleaning failure image even after the durability evaluation in which the one hundred thousand transfer materials P were fed through the image forming apparatus 100, and also resulted in an excellent wear state of the cleaning blade 31. Further, both the configurations allowed the height H of the solid lubricant 144 after the durability evaluation to fall below 6 μm, which was the average particle diameter of the toner. On the other hand, the configuration according to the sixth comparative example led to generation of the cleaning failure image before the image forming apparatus 100 finished feeding the one hundred thousand transfer materials P therethrough. However, the wear state was excellent, as the wear amount at the distal end position of the cleaning blade 31 when the cleaning failure image was generated was equal to or smaller than 6 μm, which was the average particle diameter of the toner.

Figure 9:
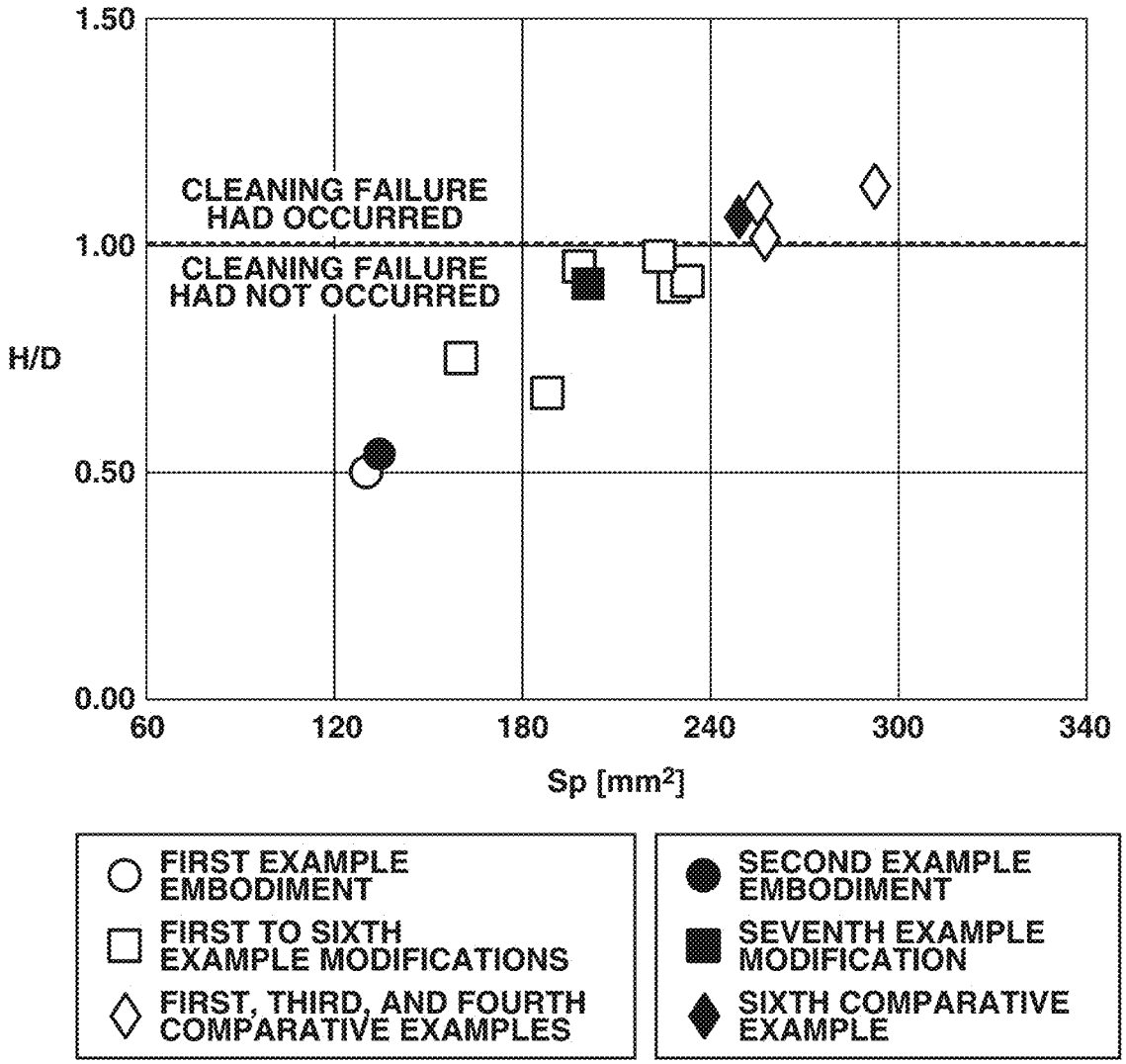
FIG. 9 is a graph illustrating a relationship between the surface area of the solid lubricant and the height of the solid lubricant deposited on the cleaning blade according to the second example embodiment.

FIG. 9 is a graph illustrating a relationship between the area $S_P$ ($mm^2$) of the solid lubricant 144 (the PTFE particles) exposed on the surface of the intermediate transfer belt 113 and the height H of the solid lubricant 144 in each of the configurations evaluated in terms of the cleaning performance in the above-described evaluation. For reference, the data of each of the configurations in the first example embodiment is also plotted in the graph illustrated in FIG. 9. As indicated in FIG. 9, the evaluation result in the present example embodiment also matches the evaluation result group in the first example embodiment, and the relationship between H/D and the area $S_P$ ($mm^2$) is also the same even with the grooves 145 shaped differently. This means that the area $S_P$ smaller than 240 $mm^2$ can also prevent or reduce the occurrence of the cleaning failure due to the detachment of the solid lubricant 144 deposited on the cleaning blade 31 in the present example embodiment similarly to the first example embodiment.

In the first example embodiment and the second example embodiment, the intermediate transfer belt has been described referring to the intermediate transfer belt including the grooves each shaped so as to be able to be approximated by the wedge shape or the trapezoidal shape by way of example, but the groove shape is not limited thereto and may be, for example, a groove shape having a semicircular shape in cross section.

Further, in the first example embodiment and the second example embodiment, the intermediate transfer belt has been described referring to the configuration including the grooves continuously formed throughout the entire range of the whole circumference of the intermediate transfer belt in the movement direction of the intermediate transfer belt, as indicated by the formula 1. However, the grooves are not limited thereto, and may be discontinued on the way without being continuously formed as long as the area $S_P$ satisfies the condition of being smaller than 240 $mm^2$. In this case, the area $S_P$ of the solid lubricant can be calculated by subtracting a length of a region where the grooves are not formed from the value of the circumferential length L of the intermediate transfer belt in the formula 1.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Applications No. 2018-087530, filed Apr. 27, 2018, and No. 2019-019540, filed Feb. 6, 2019, which are hereby incorporated by reference herein in their entirety.

What is claimed is:

1. An image forming apparatus comprising:

an image bearing member configured to bear a toner image thereon;

a movable intermediate transfer member configured to abut against the image bearing member and receive a primary transfer of the toner image borne by the image bearing member; and an abutment member provided on a downstream side of a secondary transfer portion in a movement direction of the intermediate transfer member, the secondary transfer portion being a portion where the toner image primarily transferred on the intermediate transfer member is secondarily transferred from the intermediate transfer member onto a transfer material, the abutment member being in abutment with the intermediate transfer member and configured to collect toner remaining on the intermediate transfer member after passing through the secondary transfer portion, wherein the intermediate transfer member includes a surface layer with a solid lubricant added therein on an outer peripheral surface side in abutment with the image bearing member and the abutment member, the surface layer including a plurality of grooves formed along the movement direction in a width direction of the intermediate transfer member that intersects with the movement direction, and wherein the following formula is satisfied:

$$J\times(1/K)\times L\times(Q/\rho_P)/((Q/\rho_P)+(100/\rho_A))<240,$$

where J, K, L, Q, $\rho_P$, and $\rho_A$ represent a cross-sectional length per groove with respect to the grooves, a pitch of each of the grooves, a circumferential length of the intermediate transfer member that corresponds to a region where the grooves are formed, a contained amount of the solid lubricant, a density of the solid lubricant, and a density of the surface layer, respectively.

2. The image forming apparatus according to claim 1, wherein a height of the solid lubricant, which is a distance from the surface layer to the abutment member in a thickness direction, is lower than an average particle diameter of the toner when the solid lubricant is attached from the surface layer to the abutment member.

3. The image forming apparatus according to claim 1, wherein the intermediate transfer member includes a base layer, which is a thickest layer among a plurality of layers included in the intermediate transfer member in a thickness direction, and the surface layer is formed on a surface of the base layer.

4. The image forming apparatus according to claim 3, wherein the base layer is a layer with an ion conductive agent added therein.

5. The image forming apparatus according to claim 1, wherein a width of an opening portion of each of the grooves in the width direction of the intermediate transfer member that extends orthogonally to the movement direction is 0.5 μm or wider and 3 μm or narrower.

6. The image forming apparatus according to claim 1, wherein a thickness of the surface layer is 1 μm or thicker and 5 μm or thinner.

7. The image forming apparatus according to claim 6, wherein the thickness of the surface layer is 3 μm or thinner.

8. The image forming apparatus according to claim 1, wherein the surface layer is made from acrylic copolymer.

9. The image forming apparatus according to claim 1, wherein the solid lubricant is a fluorine-containing particle.

10. The image forming apparatus according to claim 9, wherein the fluorine-containing particle is polytetrafluoroethylene (PTFE).

11. The image forming apparatus according to claim 1, wherein the abutment member is a blade made from polyurethane that is provided in abutment with the intermediate transfer member in a counter direction.

12. The image forming apparatus according to claim 1, wherein a rubber hardness of the abutment member with respect to Japanese Industrial Standard K 6253 is 70 degrees or higher and 80 degrees or lower, and an abutment pressure at which the abutment member is in abutment with the intermediate transfer member is 0.4 N/cm or higher and 0.8 N/cm or lower.

13. An image forming apparatus comprising:

an image bearing member configured to bear a toner image thereon;

a movable intermediate transfer member configured to abut against the image bearing member and receive a primary transfer of the toner image borne by the image bearing member; and an abutment member provided on a downstream side of a secondary transfer portion in a movement direction of the intermediate transfer member, the secondary transfer portion being a portion where the toner image primarily transferred on the intermediate transfer member is secondarily transferred from the intermediate transfer member onto a transfer material, the abutment member being in abutment with the intermediate transfer member and configured to collect toner remaining on the intermediate transfer member after passing through the secondary transfer portion, wherein the intermediate transfer member includes a surface layer with a solid lubricant added therein on an outer peripheral surface side in abutment with the image bearing member and the abutment member, the surface layer including a plurality of grooves formed along the movement direction in a width direction of the intermediate transfer member that intersects with the movement direction, and wherein, in accordance with movement of the intermediate transfer member, the solid lubricant having extracted from the surface layer is deposited at an abutment portion where the abutment member is in abutment with the intermediate transfer member, wherein a surface area of the surface layer in which the grooves are formed and an added amount of the solid lubricant are set in such a manner that a height of the solid lubricant having deposited at the abutment portion falls below an average particle diameter of the toner.

14. The image forming apparatus according to claim 13, wherein the following formula is satisfied:

$$J\times(1/K)\times L\times(Q/\rho_P)/((Q/\rho_P)+(100/\rho_A))<240,$$

where J, K, L, Q, $\rho_P$, and $\rho_A$ represent a cross-sectional length per groove with respect to the grooves, a pitch of each of the grooves, a circumferential length of the intermediate transfer member that corresponds to a region where the grooves are formed, a contained amount of the solid lubricant, a density of the solid lubricant, and a density of the surface layer, respectively.

15. The image forming apparatus according to claim 13, wherein the intermediate transfer member includes a base layer, which is a thickest layer among a plurality of layers included in the intermediate transfer member in a thickness direction, and the surface layer is formed on a surface of the base layer.

16. The image forming apparatus according to claim 13, wherein a width of an opening portion of each of the grooves in the width direction of the intermediate transfer member that extends orthogonally to the movement direction is 0.5 μm or wider and 3 μm or narrower.

17. The image forming apparatus according to claim 13, wherein a thickness of the surface layer is 1 μm or thicker and 5 μm or thinner.

18. The image forming apparatus according to claim 13, wherein the surface layer is made from acrylic copolymer.

19. The image forming apparatus according to claim 13, wherein the solid lubricant is a fluorine-containing particle.

20. The image forming apparatus according to claim 13, wherein the abutment member is a blade made from polyurethane that is provided in abutment with the intermediate transfer member in a counter direction.

21. The image forming apparatus according to claim 13, wherein a rubber hardness of the abutment member with respect to Japanese Industrial Standard K 6253 is 70 degrees or higher and 80 degrees or lower, and an abutment pressure at which the abutment member is in abutment with the intermediate transfer member is 0.4 N/cm or higher and 0.8 N/cm or lower.

22. The image forming apparatus according to claim 13, wherein the height of the solid lubricant having deposited at the abutment portion is a distance from the surface layer to the abutment member at the abutment portion in a thickness direction.

23. The image forming apparatus according to claim 13, wherein, in accordance with movement of the intermediate transfer member, the solid lubricant exposed on the surface layer is scraped off by the abutment member, thereby becoming deposited at the abutment portion.

* * * * *